US008550246B2

(12) United States Patent
Hofgartner

(10) Patent No.: US 8,550,246 B2
(45) Date of Patent: Oct. 8, 2013

(54) STORAGE BOX AND ASSOCIATED BLANK

(75) Inventor: Susan Hofgartner, Hungerford (GB)

(73) Assignee: Seiquelle Innovation Limited, Hungerford (GB)

( * ) Notice: Subject to any disclaimer, the term of this patent is extended or adjusted under 35 U.S.C. 154(b) by 304 days.

(21) Appl. No.: 13/203,992

(22) PCT Filed: Mar. 1, 2010

(86) PCT No.: PCT/GB2010/050354

§ 371 (c)(1),
(2), (4) Date: Aug. 31, 2011

(87) PCT Pub. No.: WO2010/100478

PCT Pub. Date: Sep. 10, 2010

(65) Prior Publication Data

US 2011/0315584 A1 Dec. 29, 2011

(30) Foreign Application Priority Data

Mar. 4, 2009 (GB) ..... 0903703.7

(51) Int. Cl.
*B65F 1/16* (2006.01)

(52) U.S. Cl.
USPC ... 206/440; 220/910; 229/117.03; 229/160.2; 229/130

(58) Field of Classification Search
USPC ..... 206/577, 581, 38, 223, 438, 440; 220/908, 910; 229/117.01, 117.03, 229/117.04, 117.13, 124, 126, 130, 160.2
See application file for complete search history.

(56) References Cited

U.S. PATENT DOCUMENTS

| | | | | | |
|---|---|---|---|---|---|
| 3,905,544 | A * | 9/1975 | Tipton | 229/169 |
| 4,402,452 | A * | 9/1983 | Kupersmit | 229/117.01 |
| 4,657,176 | A * | 4/1987 | Matsubara | 229/117.01 |
| 5,205,480 | A * | 4/1993 | Roccaforte | 229/229 |
| 6,015,045 | A * | 1/2000 | Joseph et al. | 206/494 |
| 6,120,743 | A * | 9/2000 | Papari | 422/300 |

* cited by examiner

*Primary Examiner* — Jacob K Ackun
(74) *Attorney, Agent, or Firm* — Barnes & Thornburg LLP

(57) ABSTRACT

A collapsible box for disposal of articles such as sanitary wear, comprises a base, at least three walls upstanding therefrom and a top, the top having an aperture through which articles or items may be placed in the box and a flap at least partially occluding the aperture, the flap being urged upwardly and at least a part of which being engaged by a wing portion to inhibit upward motion thereof, the wing portion being moveable between a first condition for collapsing the box and a second condition at least partially overlying the aperture.

20 Claims, 10 Drawing Sheets

STORAGE BOX AND ASSOCIATED BLANK

The present invention relates to storage boxes and, more particularly, to storage boxes constructed of flexible material such as card which are foldable into a configuration whereby they may be more readily and easily stored, e.g. they are collapsible.

Such foldable storage boxes generally comprise front, rear and side panels together with at least one base panel. The side panels are generally scored or otherwise foldable along at least a part of their length, enabling them to be pushed inwards and thus permit the front and rear panels to be brought closer to one another for at least partial collapse and storage of the box. The rear panel may also be foldable to permit more complete collapse of the box to enable it to be stored flat.

In use, the side panels are unfolded out into their original position thus separating the front and rear panels to form a storage box.

A disadvantage attendant on such boxes is that resiliently deformable materials such as card may, once folded, have a tendency to revert to the folded position. This is particularly so where a box has been stored in a folded position for some length of time. The result is that the side panels and rear panel tend to fold back to their position as stored, so collapsing (at least partially) the box.

It is from a consideration of such storage boxes and their attendant disadvantages that the present invention has been developed.

In accordance with a first aspect of the present invention, there is provided a foldable storage box comprising a front panel, a rear panel, side panels and at least one base panel, the side panels being foldable along at least part of their length to allow the box to be at least partially collapsed, wherein the box further comprises a plurality of wing portions hingedly connected with the side panels, the wing portions being foldable along at least part of their length and moveable between a first position alongside and foldable with the side panels and a second position foldable over the top of the box. Preferably the wing portions may be shaped such that in the second position they can mutually engage, e.g. abut, physically interlock or be otherwise secured together and define an aperture permitting access to the box.

The rear panel may be foldable to enable the box to be collapsed and stored flat.

In their first position, the wing portion fold lines are complementary with the fold lines of the side panels. Advantageously, in the second position the wing portions will act to resist compression or collapse of the box, preferably through rigidity of the hinge and/or through the longitudinal fold lines of the wing portions. Preferably the box further comprises a top panel comprising an aperture, the wing portions being foldable over this top panel and preferably being shaped to further define the edges of the aperture. The top panel is preferably also foldable to permit collapse of the box.

Preferably the top panel further comprises a flap at least partially occluding the aperture.

Preferably the box further comprises a lid panel moveable between a first closed position overlying and occluding the aperture and a second open position exposing the flap, the lid panel preferably being interoperably connected with the flap such that in the first closed position it will act to limit occlusion of the aperture by the flap.

The lid panel preferably comprises a handle portion.

In such a configuration, the contents of the box will preferably be hidden from view whether the lid is open or closed, thus making the box suitable for storage/disposal of e.g. sanitary towels. Rather than empty the box for re-use it may simply be disposed of.

In such a configuration the material forming the box should be waterproof or otherwise treated to resist water.

Preferably the wing portions are foldable underneath the lid panel or otherwise configured so as not to interfere with movement of the lid panel between its first and second positions, when the wing portions are in the second position. Ideally the wing portions will define the edges of the aperture so as to prevent the flap portion from moving above the top of the box.

In accordance with an associated aspect of the invention, there is provided a disposable sanitary waste box, having a configuration as described above.

In another aspect of the present invention there is provided a blank for forming a collapsible box, the blank comprising a first panel hingedly connected to a second panel by means of a third panel, the first, second and third panels being foldable to form a front panel, rear panel and side panel respectively of a box, the blank comprising a fourth panel foldable to form a further side panel of a box and hingedly connected to the first panel or the second panel, the blank further comprising at least a fifth panel foldable to form at least one base panel of a box, together with a tab permitting attachment of the fourth panel with the first or second panel to permit assembly of a box, in which the first panel will form a front, the second panel a rear and the third and fourth panels the sides of the assembled box, the third and fourth panels being scored or otherwise foldable along at least a part of their length, characterised in that the blank further comprises further panels hingedly connected to the third and fourth panels and moveable, when the box is assembled, between a first position alongside and having a fold line complementary with the third and fourth panels and a second position foldable over the top of the assembled box, the further panels being shaped such that they can interlock in the second position.

The second panel may be foldable along its width to permit an assembled box to be collapsed and stored flat.

Preferably the further panels are shaped such that in the second position they can define an aperture permitting access to the assembled box.

Preferably the blank further comprises a further panel hingedly connected with the first or second panel and defining an aperture, the panel being foldable around the first or second panel to form a top panel for the assembled box.

Preferably the further panel comprises a flap at least partially occluding the aperture.

Preferably the blank further comprises a further panel hingedly connected with the second or first panel, the panel being foldable around the second or first panel to form a lid panel for the assembled box.

The connection of the further panel may depend on which panel the top-forming panel is connected to.

Preferably the further panel comprises a first part shaped in use to occlude the aperture of the top-forming panel and a second part foldable to form a handle portion.

The further panel may comprise further portions hingedly connected to its first part to fold around and so reinforce the first part.

The blank may comprise a plurality of panels hingedly connected to any or all of the first, second, third and fourth panels and foldable around them to form a base for the assembled box.

A further aspect of the invention provides a collapsible box for storage or disposal of articles, e.g. sanitary wear, the box comprising a base, at least three walls upstanding therefrom and a top, the top having an aperture through which articles or items may be placed in the box and a flap at least partially occluding the aperture, the flap being movable between a loading position and a depositing position. At least a part of the flap may be engaged by a panel to inhibit upward motion thereof, the panel being movable between a first condition for collapsing the box and a second condition at least partially overlying the aperture. Preferably, the box may have four, five or six walls upstanding therefrom The box and/or blank may also be treated to resist cleaning chemicals, and/or may be treated to have antimicrobial properties. Additionally or alternatively the material may be treated with a fragrance material, or the box may be adapted to receive a fragrance emitter. Alternatively, the box and/or blank may be made from a material which is resistant to one or more of water and cleaning chemicals and solutions. The material may have or may have been imbued with antimicrobial properties and/or may have or be impregnated with a fragrance.

The box and/or blank may be made from laminated sheets, e.g. sheets of card, cardboard or the like.

Accordingly, blanks may be provided as flat bodies, whose major surfaces may be water and/or chemical resistant, e.g. laminated, but the edges may comprise exposed, untreated material such as card or cardboard.

The areas of exposed, untreated material may be treated to provide the blank and/or box with enhanced water and/or chemical resistance. For instance, a waterproof silicone compound such as may be used to waterproof leather may be applied, e.g. by spraying using a butane propellant.

Conveniently, a stack comprising a plurality of blanks may be treated in this way simultaneously.

It has been found that following spraying, the sprayed compound typically penetrates the exposed card or cardboard, but does not cause discolouration.

The box and/or blank may be provided in a range of colours. Accordingly, the box may be more visible and/or more aesthetically pleasing in or sympathetic to its intended site-of-use. For instance, a given colour may signify, in use, that a box is to be used for receiving a specific type of waste. In some preferred embodiments, at least a portion of the box and/or blank may be pink in colour.

In order that the invention may be more readily understood, better appreciated and more easily put into effect, reference will now be made by way of non-imitative example to the accompanying drawings, wherein.

Figure 4:
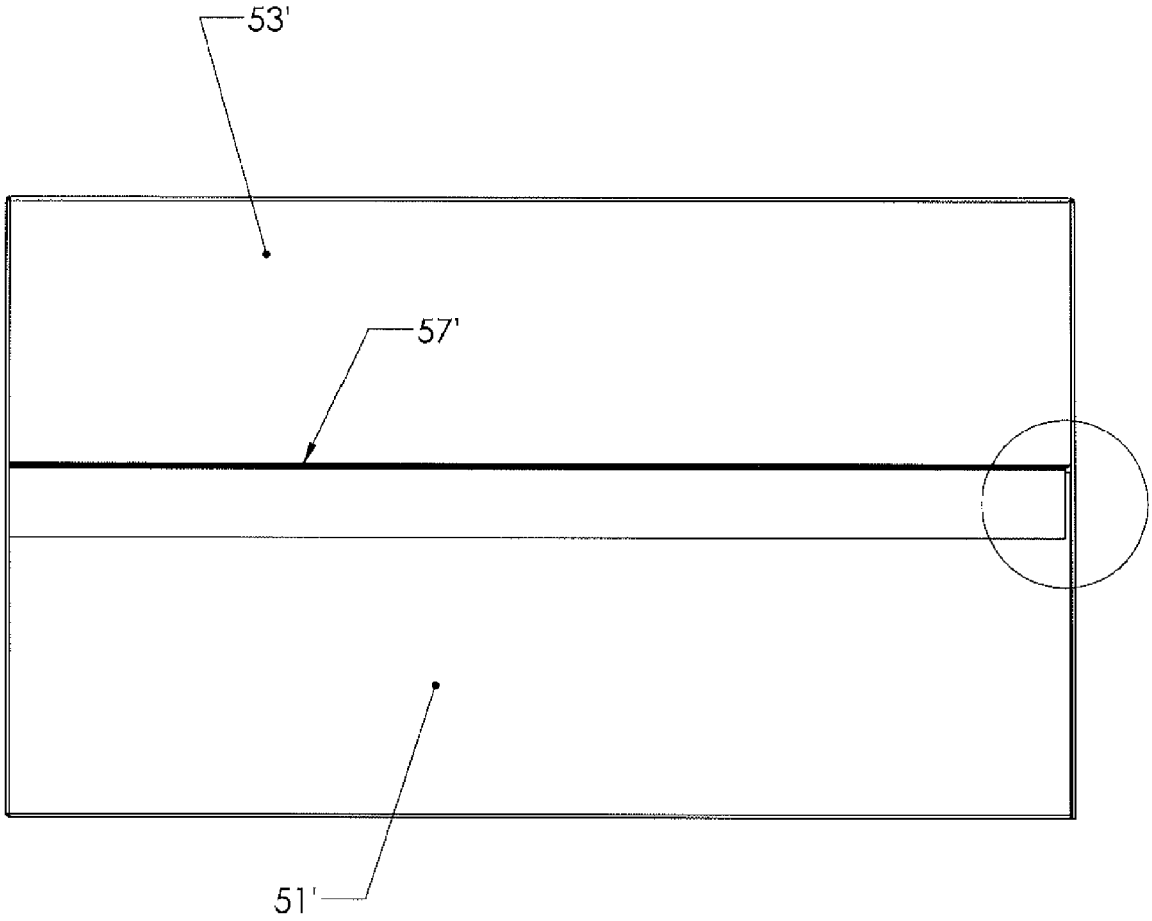
FIG. 4 shows a view of the base of the assembled box.
Figure 4A:
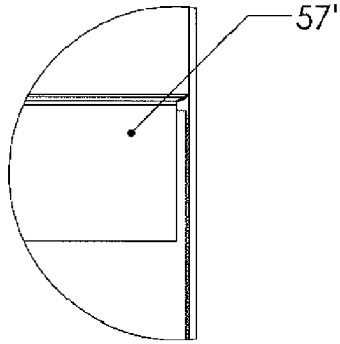
Figure 5:
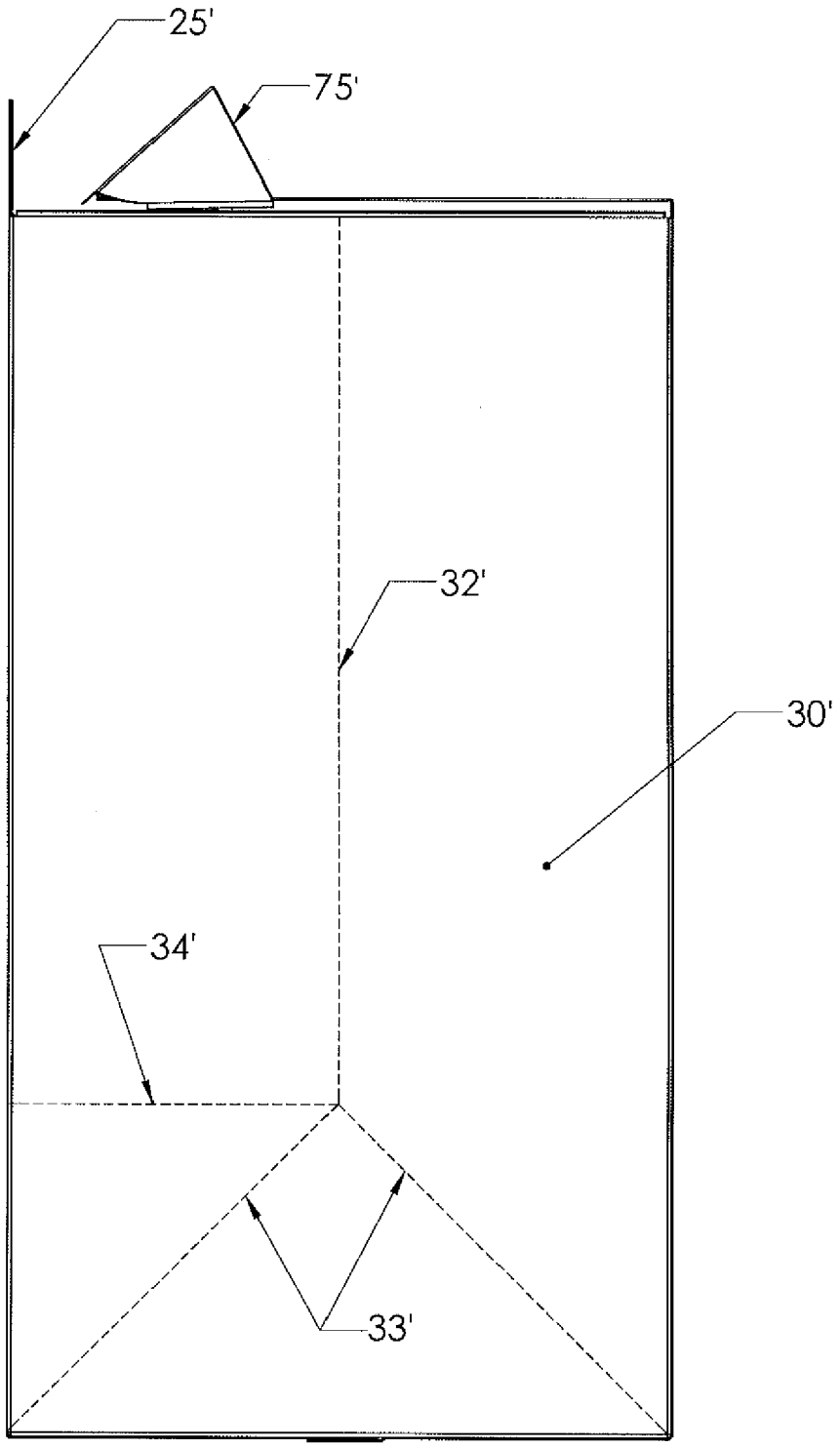
Figure 6:
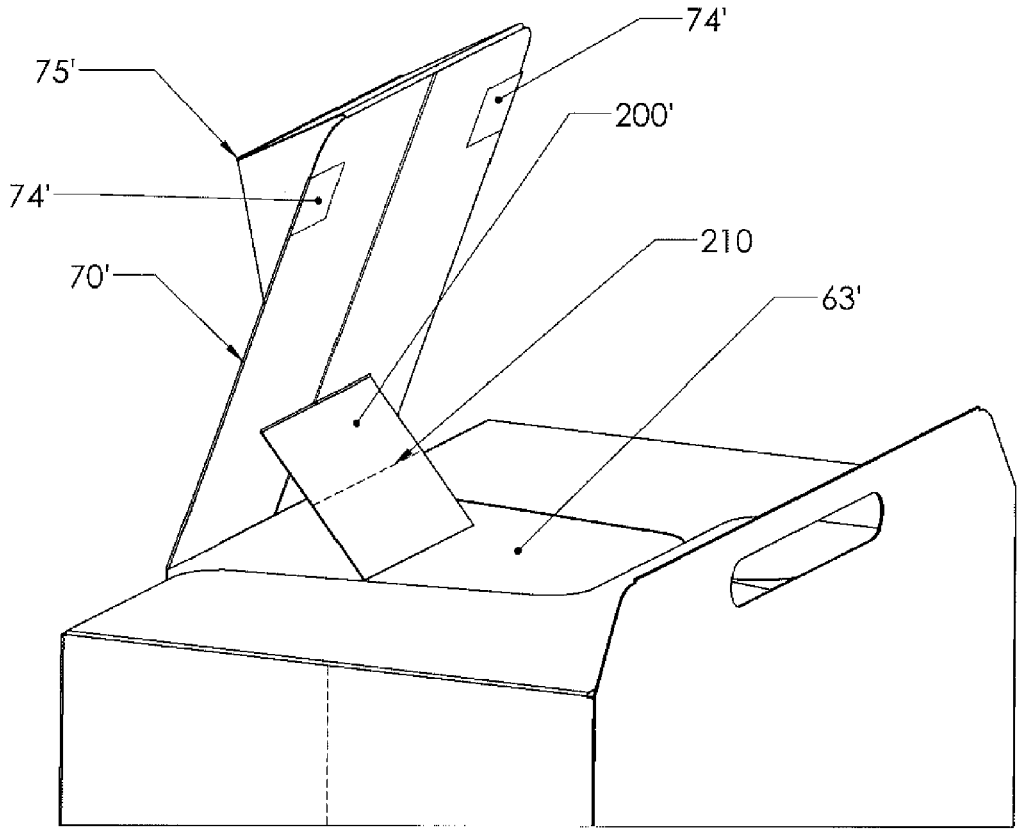
Figure 7:
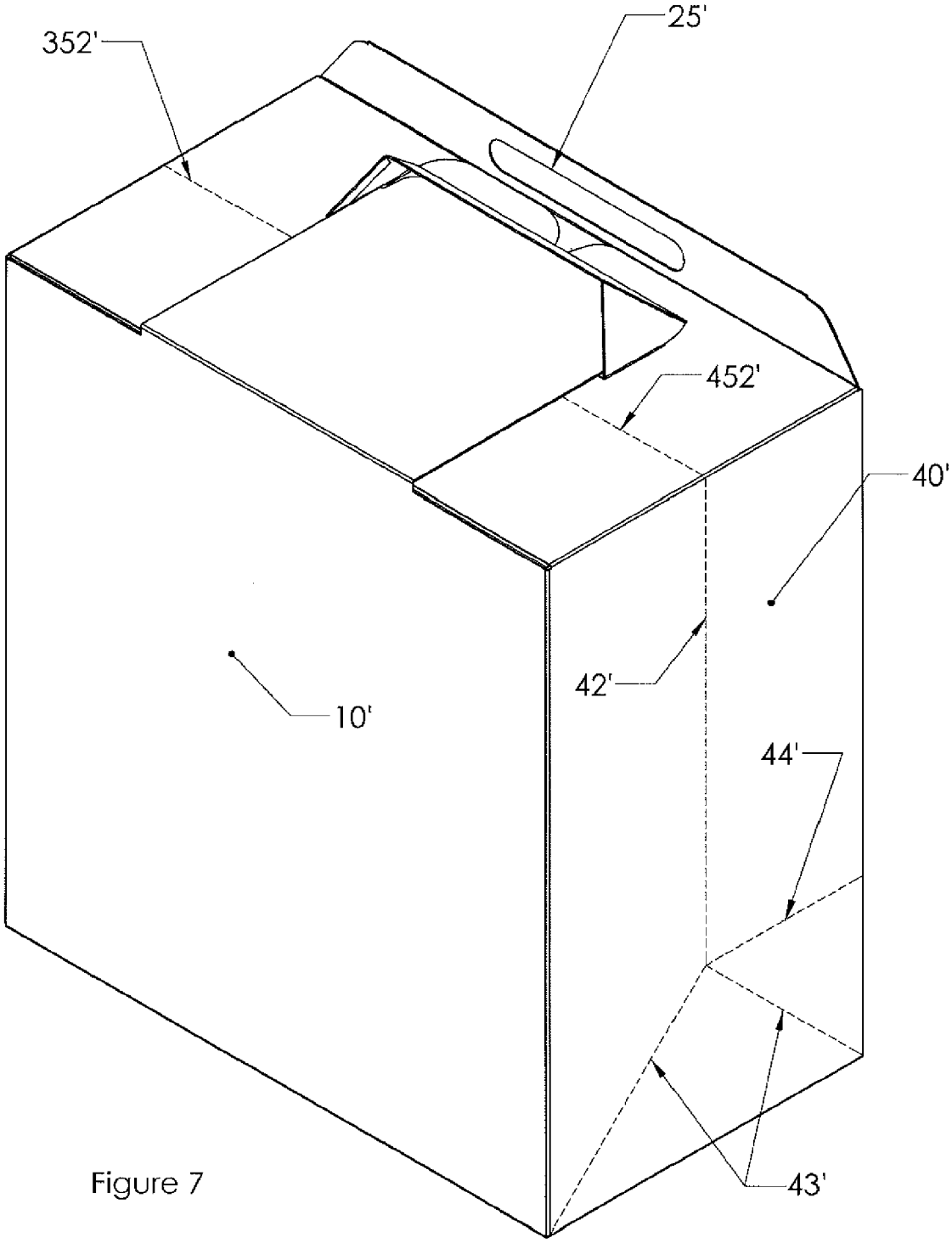
Figure 8:
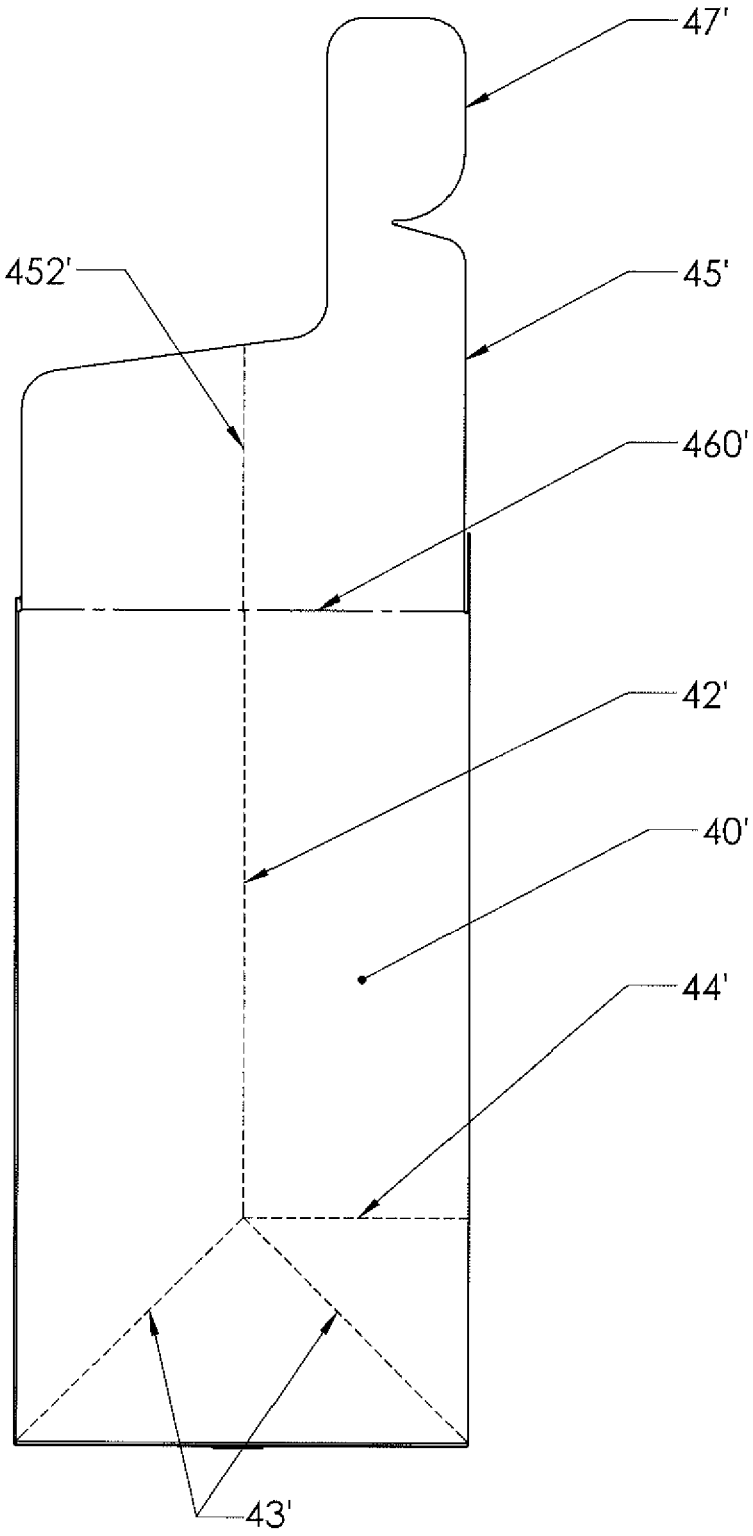
Figure 9:
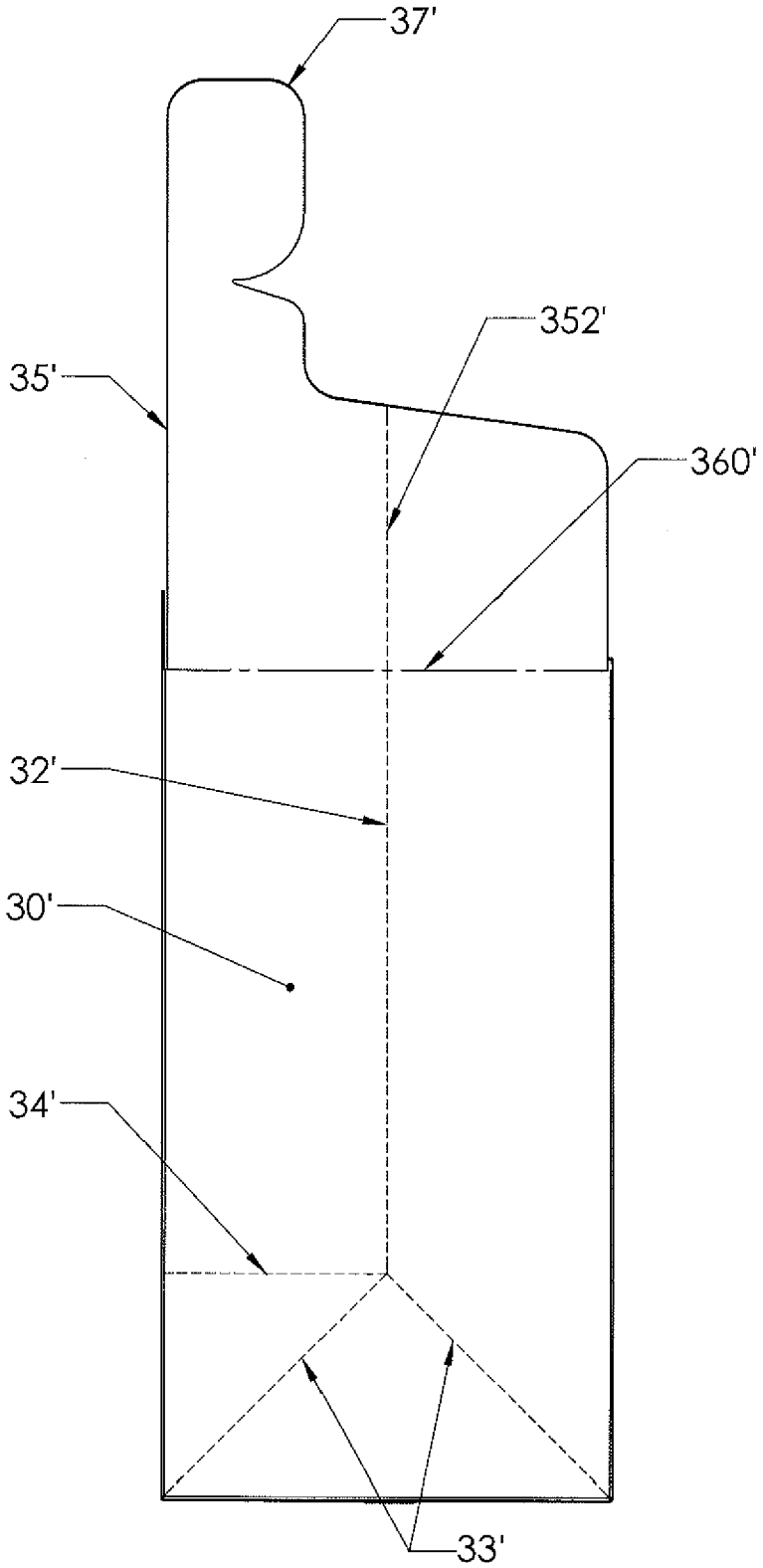
Figure 10:
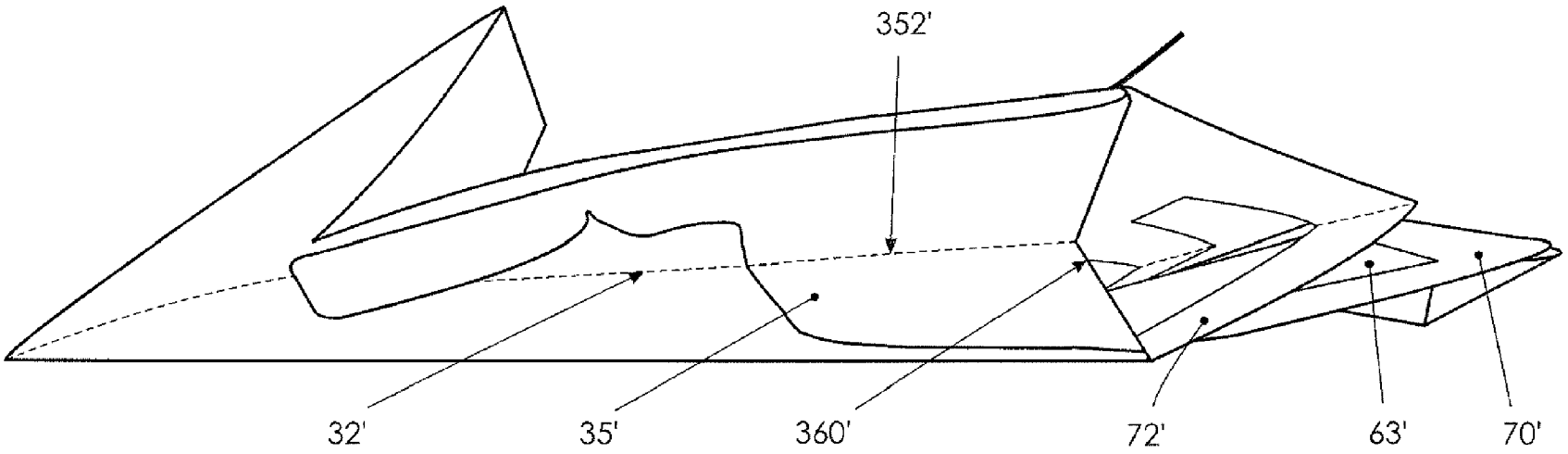

FIG. 4*a* shows a detail of FIG. 4;

FIG. 5 shows a side view of the assembled box;

FIG. 6 is a detail view of the top of the assembled box showing construction of the lid;

FIG. 7 shows an isometric view of the assembled box;

FIG. 8 shows a view of the right side of the box part-way through construction;

FIG. 9 shows a view of the left side of the box part-way through construction; and FIG. 10 shows the box in a partially collapsed state.

Figure 1:
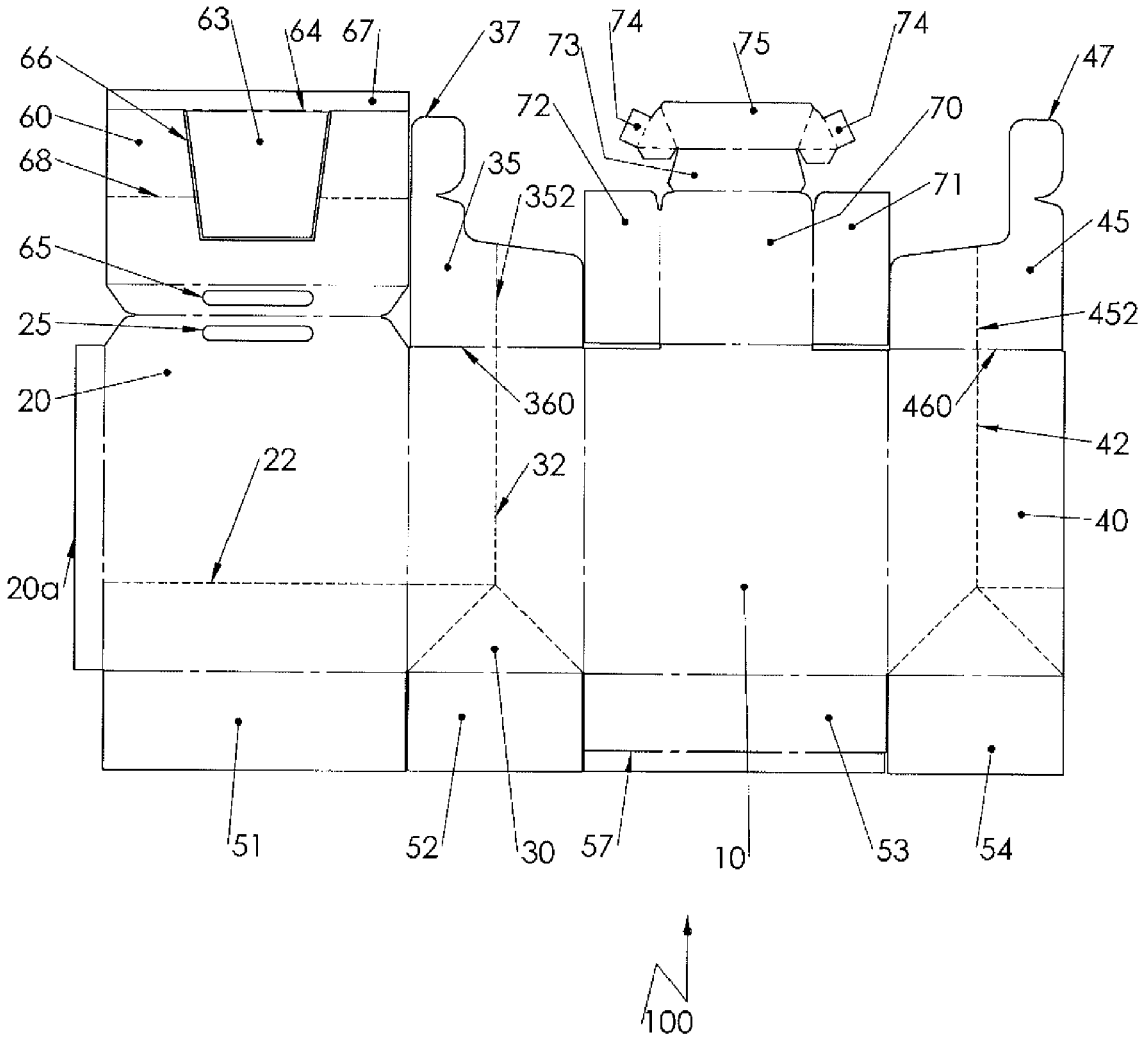
FIG. 1 shows a plan view of the blank template ready for assembly.

Referring now to FIG. 1, the present invention comprises a blank 100 foldable into a storage box and having a first panel 10 and a second panel 20 together with a third panel 30 and a fourth panel 40. Further panels 51 to 54 will form the base of the box once assembled. The panels 10, 20, 30, 40 and 51 to 54 are hingedly connected and hence foldable around the intermittent dotted lines shown. The second panel 20 may be provided with an aperture 25 which will serve as a handle for the assembled box.

Figure 2:
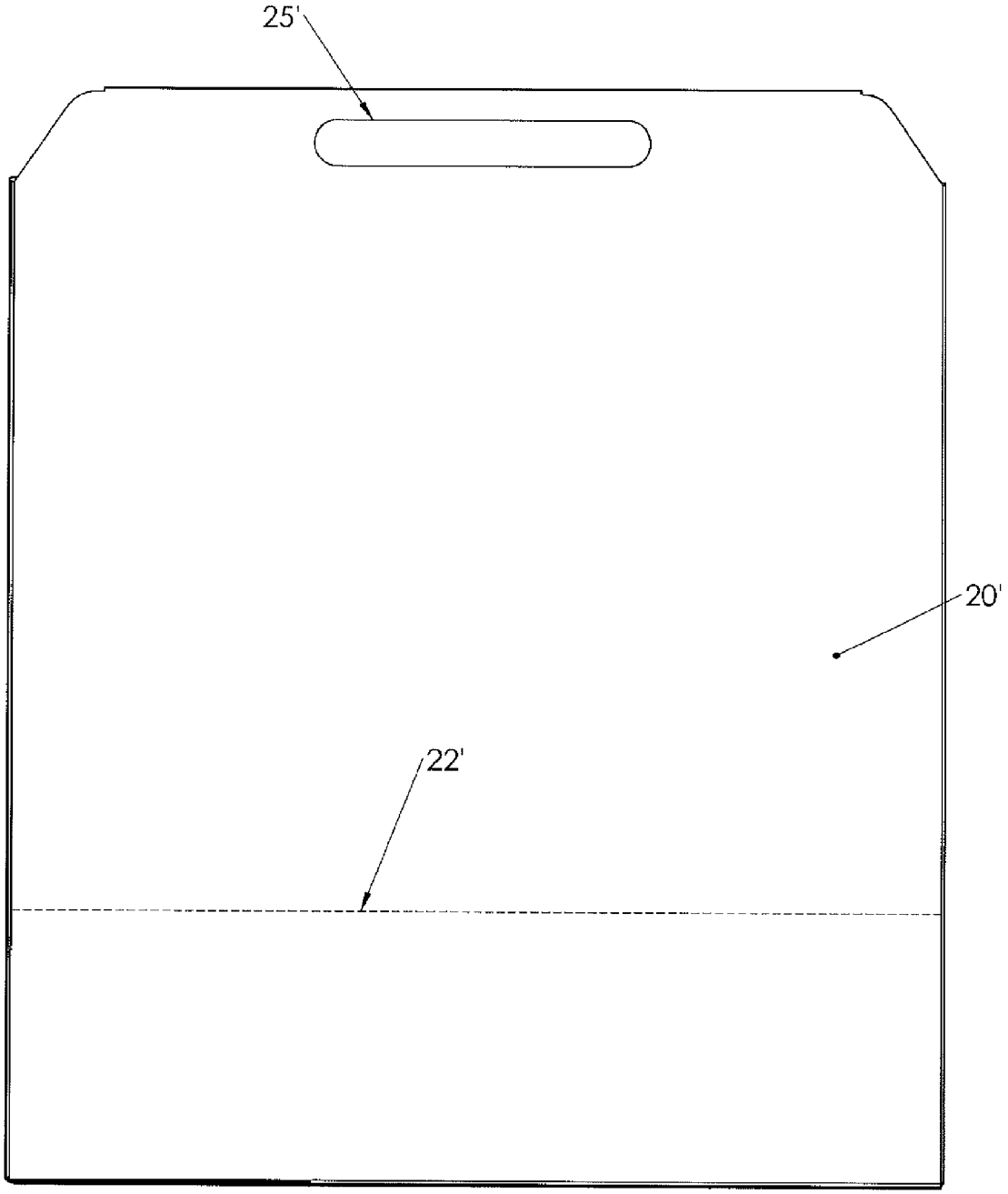
FIG. 2 shows a rear view of the assembled box.

The blank 100 is also provided with a ninth panel 60 which is likewise foldable around the intermittent dotted lines and is thus hingedly connected with the rear panel 20.

Where the second panel 20 (foldable to form the rear panel 20' of a box, shown in FIG. 2) is provided with an aperture 25, the ninth panel 60 may be likewise provided with a complementary aperture 65 which will line up with the aperture 25 of the second panel 20 to form a handle 25' (shown in FIG. 2) once the box is assembled. The ninth panel 60 may alternatively be hingedly connected to the first panel 10.

Referring back to FIG. 1, the ninth panel 60 is foldable over the second panel to form a top panel of a box. The ninth panel 60 contains an aperture 66 through which items may be placed in the assembled box. Preferably, however and as described in more detail below, the ninth panel further comprises a flap 63 hingedly connected, along a fold line 64, with the ninth panel 60 and which at least partially occludes the aperture 66. The flap 63 may be reinforced, e.g. by an additional layer of card, which may be included with the box together with an appropriate adhesive.

The second panel 20 is hingedly connected along one side to the third panel 30 and along the other side to a tab 20*a*. The blank is thus assembled into a box by connecting the tab 20*a* to the fourth panel 40 and folding in the sixth and eighth panels 52 and 54 of the third and fourth panels 30 and 40, followed by the fifth panel 51 connected to the second panel 20 and finally the seventh panel 53 connected to the first panel 10. The seventh panel 53 connected to the first panel 10 has a further fold line 57, which will overlap with the fifth panel 51 connected to the second panel 20. As shown in FIG. 4, fifth panel 51 becomes a base panel 51', which connects with the further base panel 53' via an overlap caused by the folded line 57'. FIG. 4*a* shows a detail of the overlap. Thus the fifth, sixth, seventh and eighth panels 51 to 54 will form the base panels 51' to 54' of the assembled box, while the third and fourth panels 30 and 40 will form the side panels 30' and 40' (FIGS. 8 & 9) of the assembled box. The second panel 20 forms the rear panel 20' (FIG. 2) and the first panel 10 forms the front panel 10' (FIG. 7).

It will be obvious to an addressee that the above configuration may vary: the second panel 20 may be connected to the fourth panel 40; additionally or alternatively, the fold line 57 may be on the fifth panel 51 connected to the second panel 20.

Again referring to FIG. 1, the ninth panel 60 may be folded around the second panel 20 and connected with the first panel 10 via a tab 67 to form a top panel of the assembled box.

Referring now to FIGS. 1 and 6, where the ninth panel 60 is provided with a flap 63, the blank 100 may comprise a further tenth panel 70 hingedly connected with the first panel 10. The tenth panel 70 comprises portions 71 and 72, foldable around the tenth panel 70 thereby to strengthen it, together with a further portion 73 likewise foldable around the tenth panel 70, and another portion 75 foldable against the portion 73 and fixable thereto by adhesive. The adhesive may be part of the panel and covered by a strip (not shown) until the box is assembled. Two tabs 74 may then be folded around the portions 73, 75 and affixed to the tenth panel 70, thus forming a handle portion 75' of the assembled box, with the tenth panel 70 forming a lid 70' for the assembled box. FIG. 5 shows the profile of the raised handle 75'.

Figure 3:
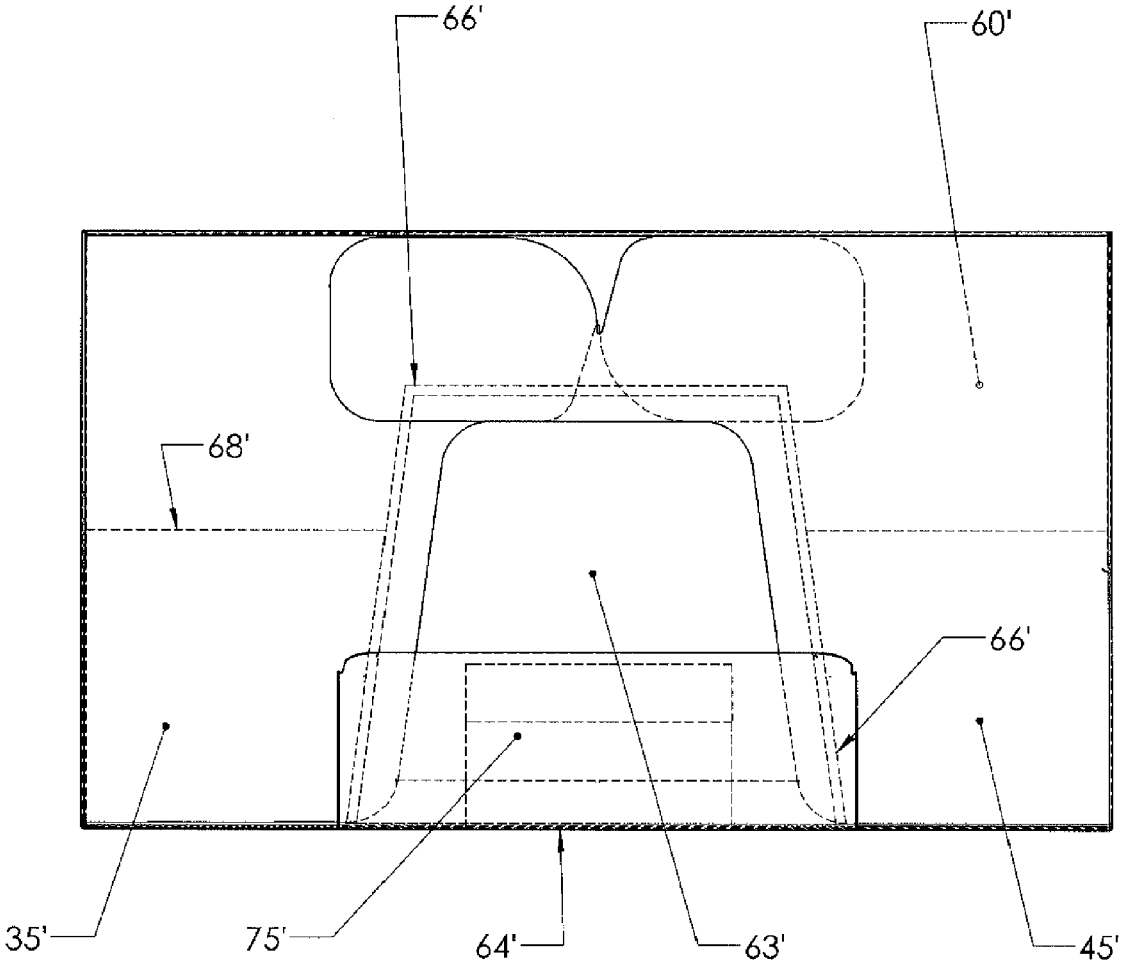
FIG. 3 is a cut-away plan view from the top of the box once assembled showing a detail of the wings.

Referring now to FIG. 6 in conjunction with FIG. 3, the lid 70' of the assembled box is connectable with the flap 63' of the top panel via an interconnecting flange 200', which may have a fold line 210 across its width. Hence the lid 70' will cover the aperture 66' (shown in FIG. 3) when the handle 75' is lowered, and the flap 63' will at least partially occlude the aperture 66' when the handle 75' is raised. In addition, the flange 200' will mean that the lid 70' can, in the closed position, act to limit occlusion of the aperture 66' by the flap 63'.

Such a box may therefore be used as a disposal box for e.g. sanitary waste without the contents being in view once disposed of. Conventional sanitary waste boxes are constructed of plastics materials and are not designed to be disposable; therefore, their use requires them to be collected or emptied on site. The present invention thus provides a disposable sanitary waste box, without the need for its being collected and/or emptied. Once the box of the present invention is filled, the lid panel 70' may be sealed down after use and the box may be disposed of. The box may be provided with a tape or other adhesive means for sealing the lid 70' to the box to prevent its opening.

Referring now to FIGS. 1, 5 and 7, the blank 100 is preferably made of card or other flexible resilient material, the blank 100 being scored or otherwise provided with further fold lines such that once assembled the box may be stored in a collapsed condition: the side panels 30' and 40' of the assembled box have fold lines 32', 42' along at least part of their length. The part 60 of the blank 100 which forms the top panel 60' has a fold line 68 across its width, while the part 20 of the blank 100 which forms the rear panel 20' has a fold line 22 across its width.

These fold lines mean that by folding the side panels 30' and 40' and the top panel, the front panel 10' and rear panel 20' may be brought into closer proximity, thus at least partially collapsing the assembled box.

Advantageously, and referring now to FIGS. 5 and 7, the side panels 30' and 40' are scored with respective fold lines 33'; 43' which extend divergently from respective fold lines 32'; 42' to approach the base of the box at an angle (best seen in FIG. 5) so as to be coincident with the lowermost corners of each respective panel 30'; 40'. Each panel 30'; 40' also includes respective fold lines 34'; 44' which extend from the convergence of lines 33', 32'; 43', 42' horizontally across the respective side panel 30'; 40' to the fold line 22' across the width of the rear panel 20'. The respective fold lines 32', 33', 34'; 42', 43', 44' enable the base of the assembled box to be folded in the same plane as the front and rear panels 10' and 20', hence permitting further collapse of the box.

The card forming the blank may be printed or otherwise configured in a decorative pattern, or otherwise made to be aesthetically pleasing. The box may be treated with a fragrance and/or have anti-microbial properties, and/or be resistant to cleaning chemicals Because card is resiliently deformable, once collapsed in this way the box may not easily revert to its original configuration, particularly after a long storage period whilst folded. Even when restored to its original configuration, the side panels 30' and 40' and rear panel 20' may in particular tend to collapse along their respective fold lines.

To overcome this and referring now to FIGS. 1, 8 and 9, the blank 100 is provided with eleventh and twelfth panels 35 and 45 which are foldable over the ninth panel 60 and which are hingedly connected to the third and fourth panels 30 and 40 of the blank 100.

The eleventh and twelfth panels 35 and 45 will form wing portions 35' and 45' of the assembled box, being foldable alongside the side panels 30' and 40' of the assembled box during storage.

As seen in FIG. 3, the eleventh and twelfth panels 35' and 45' are shaped so that when overlying the ninth panel 60' (being the top panel 60' of the assembled box) they may partially occlude the aperture 66' to prevent the flap 63' from rising higher than the top panel 60' of the box. The eleventh and twelfth panels 35' and 45' may comprise complementarily-shaped interlockable portions 37' and 47' or be connectable by other means.

During storage of the assembled box, the wing portions 35' and 45' are folded back to lie alongside the side panels 30' and 40' (see FIG. 10). Hence they have fold lines 352'; 452' along at least part of their length (shown in FIGS. 1, 8 and 9) which, in the folded condition (i.e. when wing portions 35'; 45' overlie respective panel 30'; 40'), overlie and can fold in the same direction as the fold lines 32'; 42' of the side panels 30' and 40' to enable the box to adopt a flat, folded configuration. In fact, because of the orientation and position of the fold lines 32', 352'; 42', 452', the wing portions 35'; 45' tend to snap into an overlying relation with the side panels 30', 40' when brought into proximity therewith (especially once the wing portions 35'; 45' and respective side panels 30'; 40' together describe an angle of less than 90°).

In constructing the box ready for use after storage, the wing portions 35' and 45' are folded away from the side panels 30' and 40', as seen in FIG. 8 and FIG. 9 against an urging force as described above. As the wing portions 35'; 45' are brought beyond the horizontal, the fold line 360'; 460' is brought into a straight condition. As the wing portion 35'; 45' is brought to the vertical (see FIGS. 8 and 9) the fold line 352'; 452' is directed in the opposite sense to the fold line 32'; 42' in the respective side panel 30'; 40' (i.e. the wing portion 35'; 45' will fold in to the plane of the paper as shown in FIGS. 8 and 9, whereas the panel 30'; 40' will fold out of the plane of the paper as shown in FIGS. 8 and 9). Because of the opposite direction of the fold lines 352', 32'; 452', 42' the fold line 360'; 460' is maintained in a straight or flat (as opposed to folded) configuration which helps to maintain the box in the erected state.

The wing portions 35' and 45' are interlocked by mutually engaging the cutouts therein. Once interlocked in that position, the interlock between the wing portions holds the wing portions 35' and 45' together, preventing them from returning to the folded state. Moreover, the wing portions 35' and 45' provide further residual stiffness to the assembled box. Of course the skilled person will recognise that the wing portions 35', 45' could be mutually engaged and secured using adhesive or other securing means, such as hook and eye fasteners. The adhesive may be covered by a release strip.

In unfolding up and around the top panel 60', the wing portions 35' and 45' will pass under the lid panel 70' but over the flap 63'. They must thus be shaped to permit access to the interior of the box via the aperture 66'. They may as previously discussed be shaped to further define edges of the aperture 66' and prevent the flap 63 from rising above the top panel of the assembled box.

Once assembled, the wing portions 35', 45' prevent the flap 63' from lifting up and out of overlying relations with the aperture 66'. However, the flap 63' may be pushed downwardly to allow deposit of articles within the box.

In certain embodiments, where the flap 63' is connected to the lid 70', operation of the lid 70', e.g. from raised to lowered configuration, causes the flap 63' to move from an aperture occluding position to a non occluding position.

In use, the box will be assembled from a flat condition as indicated above. The lid 70' will naturally fall into the lowered configuration (see FIG. 5). If a person wishes to deposit an article into the box they will raise the lid 70' using the handle 75' which will cause the flap 63' to be pivotally raised into an aperture occluding position (see FIG. 6). An article (not shown) may then be deposited onto the flap 63' and the lid 70' lowered. As the lid 70' is lowered, preferably using the handle 75', the flap 63' is pivoted downwardly through the action of interconnecting flange 200' and/or the weight of the article and/or gravity to cause the article to be deposited within the box. The lid portion 70' will naturally adopt the lowered configuration thereby inhibiting access to, and sight of, the contents of the box. The use of the handle 75' and flap-operating lid 70' ensures that the user has to make minimal contact with the flap 63'.

In other embodiments the flap 63' may be urged towards the aperture occluding position by a further member, e.g. a member bearing against the underside of the flap connected to the inside of the box. In such a case, once a downward urging force is removed from the flap 63' it will naturally adopt its aperture 66' occluding position. In this way, the contents of the box are not viewable without applying a downward force to the flap 63'.

In which case the box will usually be provided with a lid portion so as to cover the flap 63' when not in use.

In such a manner the contents of the box are always isolated from the outside world and the user.

Once the box is full, or when a specified use period has expired the box is simply removed and a new box put in its place. The used box including the contents may be disposed of using best practice.

Clearly, such a disposable box has many benefits over conventional plastic bins, not least where the deposited items are soiled or include biological material, for example tampons and other female sanitary wear, nappies or diapers, incontinence devices, tissues, toilet paper, bandages, sutures, used dressings.

Various modifications of the box and blank may be considered without departing from the invention.

The invention claimed is:

1. A collapsible box for disposal of articles such as sanitary wear, the box comprising a base, at least three walls upstanding therefrom and a top, the top having an aperture through which items may be placed in the box, a wing portion extending from a wall being movable between a first condition for collapsing the box and a second condition at least partially overlying the top and a movable flap arranged to be able to at least partially occlude the aperture, at least a part of the flap being engaged or engagable by one or both of the top and the wing portion to inhibit upward motion thereof.

2. A collapsible box as claimed in claim 1, further comprising a fourth wall upstanding from the base.

3. A collapsible box according to claim 1, further comprising a fourth wall upstanding from the base and a second wing portion extending from a wall, wherein the second wing portion is foldable from a first condition for collapsing the box and a second condition at least partially overlying the top.

4. A collapsible box according to claim 1, further comprising a fourth wall upstanding from the base and a second wing portion extending from a wall, wherein the second wing portion is foldable from a first condition for collapsing the box and a second condition at least partially overlying the top and is interengageable with said first wing portion in said second condition.

5. A collapsible box according to claim 1, further comprising a fourth wall upstanding from the base and a second wing portion extending from a wall, wherein the second wing portion is foldable from a first condition for collapsing the box and a second condition at least partially overlying the top and wherein in the second condition, at least partially overlies the aperture.

6. A collapsible box according to claim 1, further comprising a lid arranged to be movable to cover the aperture.

7. A collapsible box according to claim 1, further comprising a lid arranged to be movable to cover the aperture, wherein the lid is operable from a lowered configuration to a raised configuration and wherein the lid is operably connected to the flap and, when raised upwardly, urges said flap upwardly.

8. A collapsible box as claimed in claim 1, further comprising a lid arranged to be movable to cover the aperture, wherein the lid is secured to the flap.

9. A collapsible box as claimed in claim 1, further comprising a lid arranged to be movable to cover the aperture, wherein the lid comprises a handle.

10. A blank for forming a collapsible box, comprising:

a first panel hingedly connected to a second panel via a third panel;

at least a fourth panel;

a tab permitting attachment of the first panel with the third panel to permit assembly of a box in which the first panel will form a front, the second and third sides and the fourth panel the base of the assembled box;

the third panel being scored or otherwise foldable along at least a part of its length, wherein the blank further comprises a further panel hingedly connected to the third panel and moveable between a first position alongside the third panel and a second position foldable over the top of the assembled box, the further panel being shaped such that it can fixedly locate in the second position.

11. A blank for forming a collapsible box, comprising:

a first panel hingedly connected to a second panel via a third panel;

a fourth panel hingedly connected to the first panel or the second panel;

at least a fifth panel;

a tab permitting attachment of the fourth panel with the first or second panel to permit assembly of a box in which the first panel will form a front, the second a rear, the third and fourth the sides, and the fifth panel the base of the assembled box;

the third and fourth panels being scored or otherwise foldable along at least a part of their length, wherein the blank further comprises a plurality of further panels hingedly connected to the third and fourth panels and moveable between a first position alongside the third and fourth panels and a second position foldable over the top of the assembled box, the further panels being shaped such that they can fixedly locate in the second position.

12. A blank as claimed in claim 11, wherein the further panel is shaped such that in the second position it can define an aperture.

13. A blank as claimed in claim 12, wherein the further panels are shaped such that in the second position they can define an aperture.

14. A blank as claimed in claim 11, wherein the blank further comprises a further panel hingedly connected with the first or second panel and defining an aperture, this further panel being foldable around the first or second panel to form a top panel for the assembled box.

15. A blank as claimed in claim 12, wherein the blank further comprises a further panel hingedly connected with the first or second panel and defining an aperture, this further panel being foldable around the first or second panel to form a top panel for the assembled box.

16. A blank as claimed in claim 12, wherein the blank further comprises a further panel hingedly connected with the first or second panel and defining an aperture, this further panel being foldable around the first or second panel to form a top panel for the assembled box, wherein the top-forming panel further comprises a flap at least partially occluding the aperture.

17. A blank as claimed in claim 12, wherein the blank further comprises a further panel hingedly connected with the first or second panel and defining an aperture, this further panel being foldable around the first or second panel to form a top panel for the assembled box, wherein the top-forming panel further comprises a flap at least partially occluding the aperture, wherein the blank further comprises a further panel hingedly connected with the second or first panel, this panel being foldable around the second or first panel to form a lid for the assembled box.

18. A blank as claimed in claim 12, wherein the blank further comprises a further panel hingedly connected with the first or second panel and defining an aperture, this further panel being foldable around the first or second panel to form a top panel for the assembled box, wherein the top-forming panel further comprises a flap at least partially occluding the aperture, wherein the blank further comprises a further panel hingedly connected with the second or first panel, this panel being foldable around the second or first panel to form a lid for the assembled box, the lid-forming panel comprising a first part shaped in use to occlude the aperture of the top-forming panel and a second part foldable to form a handle portion.

19. A blank as claimed in claim 12, wherein the blank further comprises a further panel hingedly connected with the first or second panel and defining an aperture, this further panel being foldable around the first or second panel to form a top panel for the assembled box, wherein the top-forming panel further comprises a flap at least partially occluding the aperture, wherein the blank further comprises a further panel hingedly connected with the second or first panel, this panel being foldable around the second or first panel to form a lid for the assembled box, the lid-forming panel comprising a first part shaped in use to occlude the aperture of the top-forming panel and a second part foldable to form a handle portion, and wherein the lid-forming panel comprises further portions hingedly connected to its first part to fold around and so reinforce the first part.

20. A blank according to claim 12, wherein the material forming the blank is waterproof or otherwise treated to resist water and/or is treated to resist cleaning chemicals, and/or treated to have antimicrobial properties and/or treated with a fragrance material, and/or adapted to receive a fragrance emitter.

* * * * *